United States Patent [19]

Boyd

[11] Patent Number: 4,672,779

[45] Date of Patent: Jun. 16, 1987

[54] PORTABLE SHELTER

[76] Inventor: Clarence J. Boyd, 2595 - 3 Mile Rd., Traverse City, Mich. 49684

[21] Appl. No.: 280,136

[22] Filed: Jul. 2, 1981

[51] Int. Cl.[4] ..... E04H 1/12

[52] U.S. Cl. ..... 52/79.4; 52/79.5; 52/82; 52/71

[58] Field of Search ..... 52/82, 236.1, 79.4, 52/71, 66, 72, 200, 245, 86, 79.5

[56] References Cited

U.S. PATENT DOCUMENTS

| | | |
|---|---|---|
| 1,541,556 | 6/1925 | Fisher . |
| 2,256,050 | 9/1941 | Hansen . |
| 2,278,956 | 4/1942 | Wagner . |
| 3,144,881 | 8/1964 | Sproull . |
| 3,152,366 | 10/1964 | McCrory et al. . |
| 3,281,999 | 11/1966 | Keely . |
| 3,394,508 | 7/1968 | Burke, Jr. et al. . |
| 3,475,872 | 11/1969 | Suhr . |
| 3,685,221 | 8/1972 | Mangan . |
| 3,763,608 | 10/1973 | Chamlee . |
| 3,835,602 | 9/1974 | Tuuri . |
| 3,921,354 | 11/1975 | Connelly et al. . |
| 3,996,706 | 12/1976 | Bomgaars . |
| 4,048,770 | 9/1977 | McKenzie ..... 52/82 |
| 4,100,705 | 7/1978 | Diana . |
| 4,173,855 | 11/1979 | Raptoplous . |

*Primary Examiner*—Reinaldo P. Machado
*Attorney, Agent, or Firm*—Price, Heneveld, Cooper, DeWitt & Litton

[57] ABSTRACT

A portable shelter for hunting, fishing, storage, and the like, comprises a collapsible base having a regular, polygonal configuration, and a collapsible side wall having a plurality of dihedrally shaped panels mounted on the base. A collapsible roof is supported on the side wall, and comprises a plurality of dihedrally shaped panels which are detachably interconnected to form a pitched roof over the assembled side wall. A door is mounted in one of the side wall panels to permit ingress and egress from the shelter.

30 Claims, 14 Drawing Figures

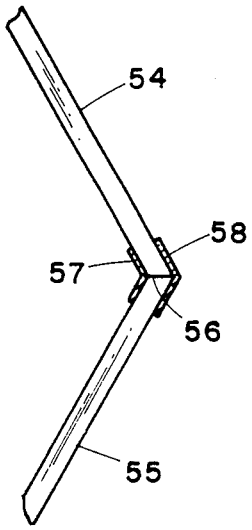
FIG 7
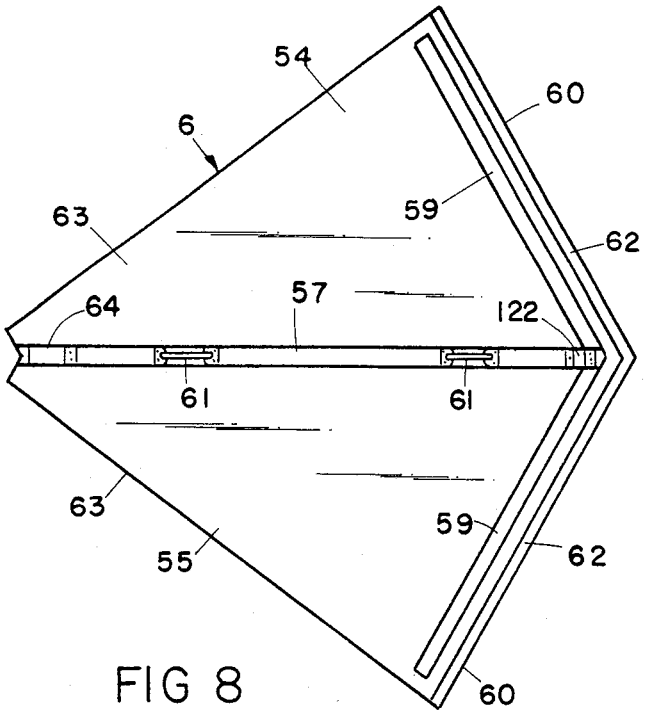
FIG 8
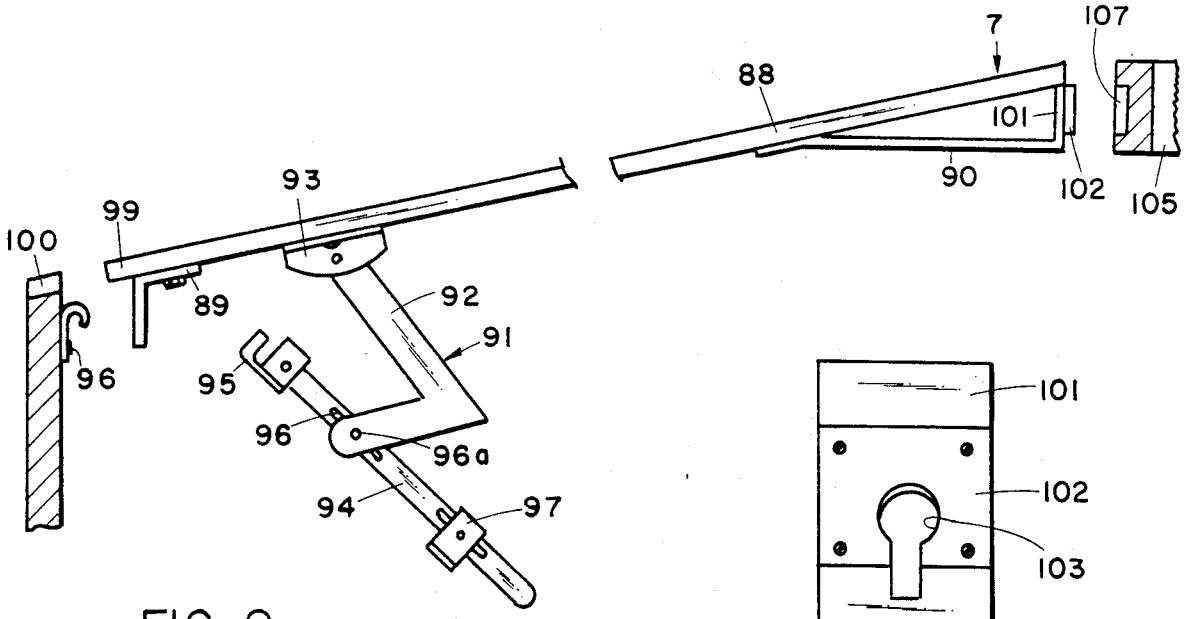
FIG 9
FIG 10

PORTABLE SHELTER

BACKGROUND OF THE INVENTION

The present invention relates to building constructions, and in particular to a portable shelter.

Portable shelters are used for fishing, hunting, storage and other similar applications. Soft shelter constructions, such as tents, are readily portable, but do not provide sufficient protection against snow, high winds, and other similar inclement weather conditions. Also, such structures are not impervious to large animals, such as bears, and the like.

Although prefabricated rigid shelters are known in the art, they are typically difficult to assemble, and not particularly adapted to be transported from one site to another.

SUMMARY OF THE INVENTION

One aspect of the present invention is a portable shelter, comprising a collapsible base having a plurality of legs adapted to be interconnected in a regular, polygonal configuration, with an upwardly oriented channel extending about the base. A collapsible side wall includes a plurality of dihedrally shaped panels having a lower edge shaped for reception into the channel in the base, and adapted for assembly on the base in a side-by-side relationship to form a closed perimeter. The base legs and side walls are detachably interconnected to form a rigid structure on which a roof is supported.

The principal objects of the present invention are to provide an extremely strong, safe and rigid portable shelter construction capable of withstanding severe, inclement weather conditions, and will not blow over even when subjected to high winds. The shelter has the strength and conveniences provided by permanent structures, yet is collapsible so that it can be easily transported from one site to another, even by one person. The shelter is sufficiently strong that it can be used not only for fishing, hunting, etc., but also as a greenhouse, a guesthouse, and many other recreational applications. The various pieces of the shelter are designed to be nested together for convenient storage, and are easily interconnected to form a weathertight construction. The shelter is designed for efficient, economical manufacture, and is provided with special latches, which enable the shelter to be assembled and disassembled without tools. The shelter is extremely durable, and particularly well adapted for the proposed use.

These and other features, advantages, and objects of the present invention will be further understood and apprciated by those skilled in the art by reference to the following written specification, claims, and appended drawings.

BRIEF DESCRIPTION OF THE DRAWINGS

FIG. 7 is an end elevational view of a roof panel.

FIG. 8 is a bottom plan view of the roof panel.

FIG. 9 is a fragmentary, exploded side elevational view of a rafter support for the roof panels.

FIG. 10 is a front elevational view of the upper end of the roof panel support.

DETAILED DESCRIPTION OF THE PREFERRED EMBODIMENTS

Figure 1:
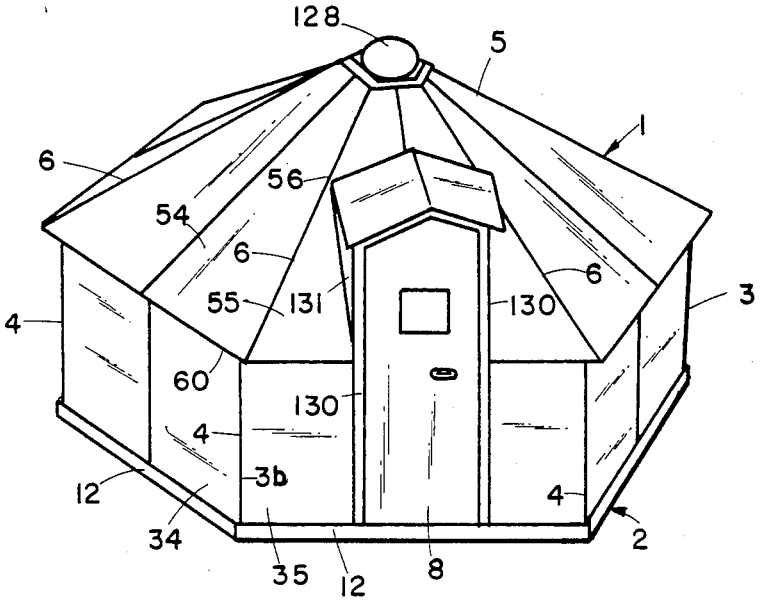
FIG. 1 is a perspective view of a portable shelter embodying the present invention.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations, except where expressly specified to the contrary.

The reference numeral 1 generally designates a portable shelter embodying the present invention, comprising a collapsible base 2, having a regular polygonal configuration, and a collapsible side wall 3, having a plurality of dihedrally shaped panels 4 mounted on base 2. A collapsible roof 5 is supported on side wall 3, and comprises a plurality of dihedrally shaped panels 6 which are releasably are detachably interconnected and supported on removable rafters 7 to form a pitched roof over the assembled side wall 3. A door 8 is mounted in one of the side wall panels 4 to permit ingress and egress from the shelter.

Figure 2:
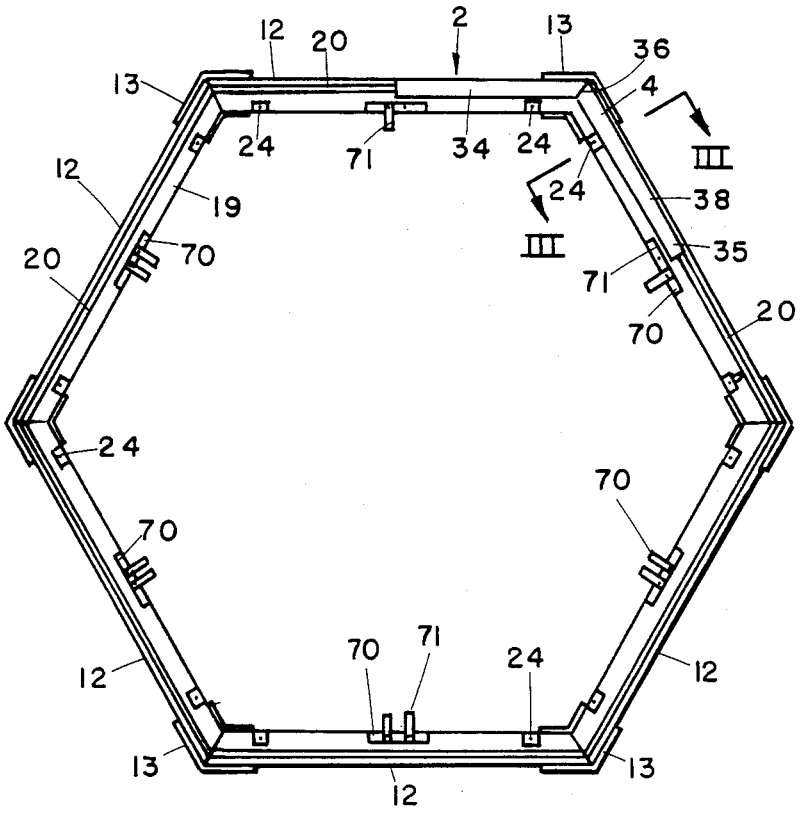
FIG. 2 is a top plan view of a base portion of the portable shelter, with one side wall panel mounted therein.
Figure 3:
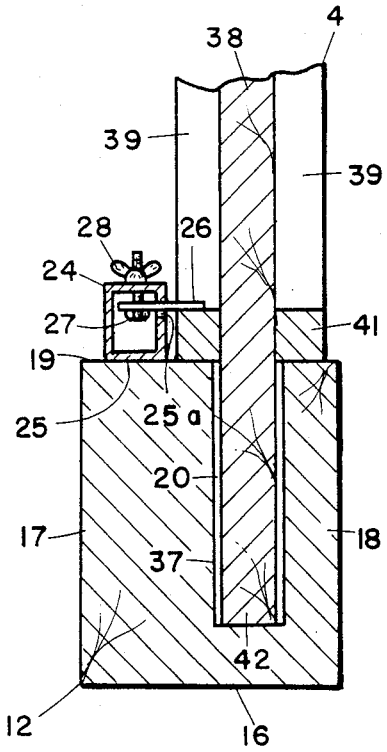
FIG. 3 is a fragmentary, vertical cross-sectional view of the shelter base and side wall, taken along the line III—III, FIG. 2.

As best illustrated in FIGS. 2 and 3, shelter base 2 comprises a plurality of rail shaped legs 12, having their ends beveled, and detachably interconnected to form a regular, polygonal configuration. In the illustrated example, shelter base 2 has a hexagonal plan shape, with six legs 12, having a substantially similar configuration. Adjacent ends of base legs 12 are interconnected by channel shaped brackets 13. Conventional fasteners, such as wood screws, through bolts, or the like (not shown) are used to attach brackets 13 to the adjacent ends of legs 12. Brackets 13, as well as the ends of legs 12, have an included angle between adjacent legs of approximately 120°. Although the illustrated base 2 has an open floor, it is understood that a non-integral or soft floor cover, such as canvas, plastic, or the like can be provided.

In the example illustrated in FIG. 3, base legs 12 have a substantially rectangular transverse cross-sectional shape, including a bottom surface 16, interior and exterior surfaces 17 and 18 respectively, and a top surface 19. Each base leg 12 includes a U-shaped channel 20 through the upper surface 19 thereof, which extends continuously along the length of the leg.

Each base leg 12 includes two hold down clips 24 positioned adjacent the end of the leg to attach side wall panels 4 to base 2. Each clip 24 has a hollow body 25 anchored to the upper surface 19 of base leg 12, along the interior side thereof. Clip body 25 has a window or aperture 25*a* oriented toward the exterior of the shelter, in which a lever or tongue 25 is positioned. The interior end of clip tongue 25 is mounted on a fastener 27, which extends through the top of clip body 25, and includes a wing nut 28 attached to the upper end thereof. Rotation of wing nut 28 pivots the free end of clip tongue 26 upwardly and downwardly to connect side wall panels 4 to base 2.

Each base leg 12 further includes a double latch 70 attached to a medial portion thereof along the interior side of the base leg to interconnect adjacent side wall panels 3, as described in greater detail hereinafter.

Figure 4:
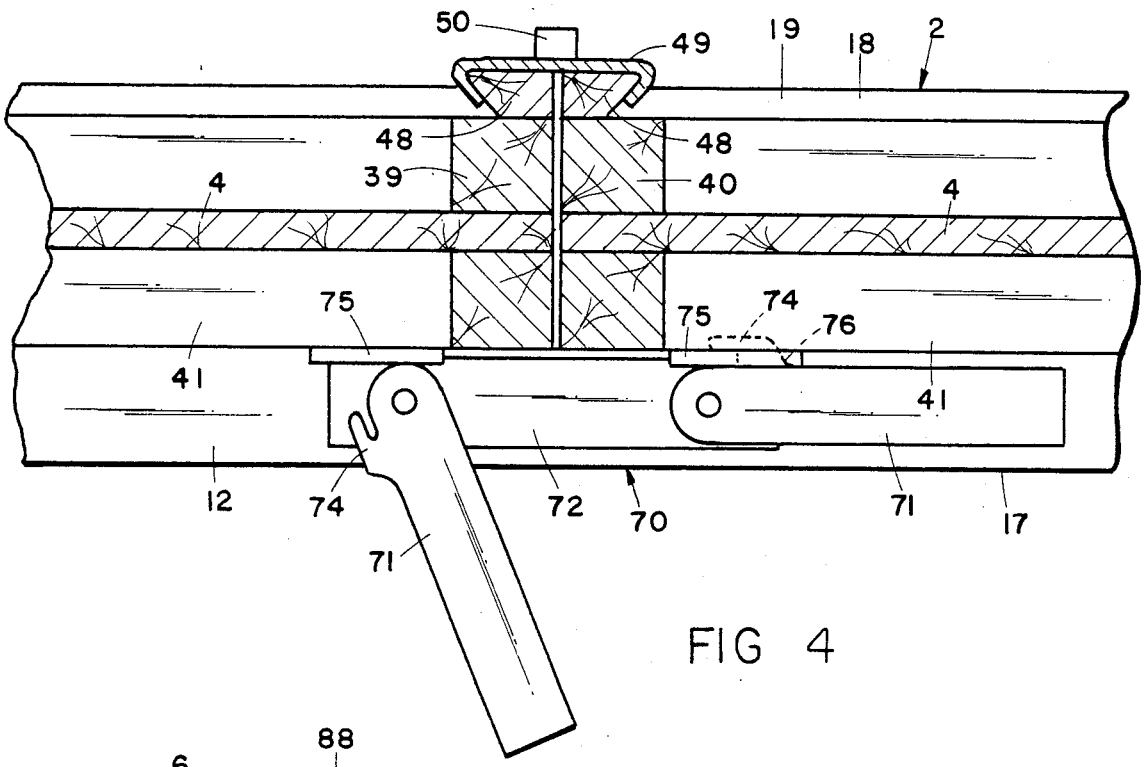
FIG. 4 is a top plan view of a latch mechanism for interconnecting the side edges of adjacent side wall panels.

Side wall 3 has a regular polygonal plan shape which is geometrically similar to the plan shape of base 2. In this example, side wall 3 comprises six side wall panels 4 arranged in an equilateral hexagon configuration. Side wall panels 4 (FIGS. 1–3) each comprise two flat, rigid sheets 34 and 35, which are rigidly interconnected along a common vertical edge 36 in an angular relationship which mates with the angle between adjacent legs 12 of base 2. Side wall panels 4 have a lower edge 37 shaped for reception into the channel 20 of base 2, and are adapted for assembly on base 2 in a side-by-side relationship to form a closed perimeter. In the illustrated example, panel sheets 34 and 35 have a substantially identical rectangular shape, are constructed of plywood, and have an included angle in the nature of 120°. Hence, side wall panels 4 have a symmetrical configuration which permits them to be nested together for storage. Preferably, each side wall panel 4 is constructed from a single 4×8 foot sheet of plywood cut along the transverse axis thereof so that sheets 34 and 35 have a 4×4 foot size, thereby minimizing waste and material costs. Frame members 38–40 are attached along the upper edge and side edges of each sheet 34 and 35 respectively, on both sides thereof. A lower frame member 41 extends along the base of both sheets 34 and 35, spaced upwardly from the lower edge 37 thereof to form a depending tongue 42 which is received in groove 20. The lower frame elements 41 abut the upper surface 19 of base legs 12, and help support side wall panels 4 thereof. Side wall panel sheets 34 and 35 have a width substantially equal to one-half the length of base legs 12, so that the sides of adjacent panels abut when assembled on base 2. As best illustrated in FIG. 4, the side edges of each side wall panel 4 include a beveled rail 48 extending along the length thereof on the exterior side of the side wall panel. A similarly beveled cap 49 is adapted to mate with an adjacent pair of rails 48 in an abutting relationship. Cap 49 structurally joins the adjacent side wall panels, and simultaneously forms a weatherproof, dovetail joint or seal therebetween. The beveled rails 48 and cap 49 are preferably tapered laterally outwardly toward the base, so that cap 49 acts as a wedge lock which securely and positively holds adjacent side panel edges together. A V-shaped channel (not shown) can be mounted over the exterior side of common edge 36 to provide additional protection and rigidity to side wall panels 4. A handle 50 is attached to the exterior surface of cap 49 to facilitate sliding cap 49 over adjacent rails 48. The upper edge of side wall panels 4 are preferably beveled at an angle of approximately 30 degrees to mate flush with roof panels 5.

Side wall panels 4 are releasably interconnected and attached to base 2 in a manner which forms a self-supporting or freestanding side wall capable of supporting roof 5 thereon without the aid of trusses, ground posts, or other similar supports which interfere with the usable space available on the interior of the shelter. The dihedrally shaped side wall panels 4 are sequentially positioned on an associated corner portion of base 2, with depending tongue 42 received within base channel 20. The dihedral or wedge-shape of the side wall panels 4 provides a very secure and rigid mounting for the side wall panels, such that the shelter can be erected even under high wind conditions.

As the side wall panels 4 are set in place on base 2, they are interconnected in the following fashion. With reference to FIG. 4, a dual lever spanner latch 70 is attached to each base leg 12 at the center thereof, and includes a pair of latch levers 71 pivotally mounted on a base plate 72. Each lever 71 includes a hook shaped extension or prong 74 located near the pivot end of the lever. A mating plate 75 is attached to the lower frame member 41 of the adjacent side wall panels 4, and includes a window 76 located adjacent the pivot end of lever 71, so that when pivot arm 71 is rotated fully inwardly, as illustrated by the lever on the right hand side of FIG. 4, prong 71 extends through window 76 to capture plate 75 therein. When latch lever 71 is pivoted outwardly, as illustrated by the lever on the left hand side of FIG. 4, prong 74 disengages plate 75, so that side wall panels 4 can be easily disassembled. When both latch levers 71 are rotated inwardly, latch mechanism 70 both interconnects the side edges of adjacent side wall panels along the bottom thereof, and also securely connects both side wall panels 4 to base 2.

The previously described hold down clips 24 attach to the frame segments 41 on side wall panels 4, adjacent the interior thereof, and securely hold the corner of the panels to the base. Clips 24 are secured by simply tightening wing nuts 28.

Figure 5:
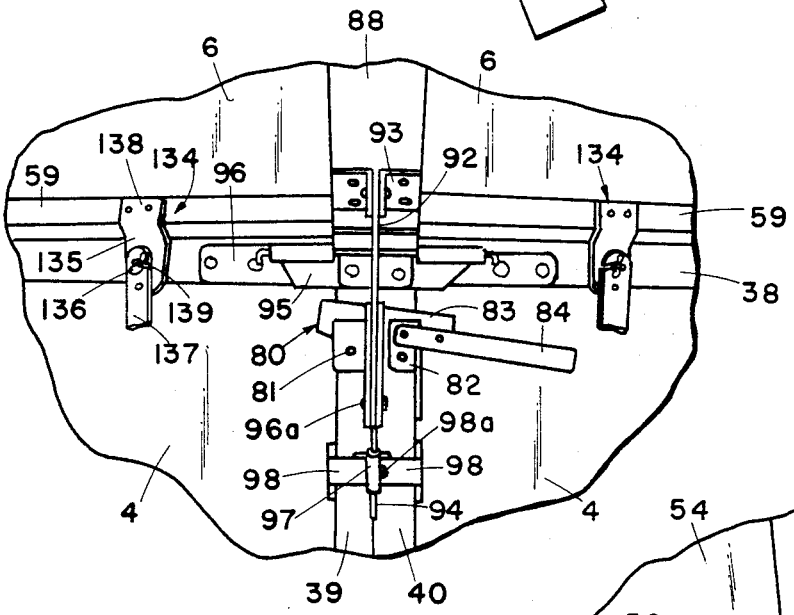
FIG. 5 is a fragmentary, perspective view of a latch mechanism for interconnecting the roof and side wall panels of the shelter.

As best illustrated in FIG. 5, an overcentered locking latch 80 is provided at the upper end of adjacent side wall panels 4 to interconnect the same. Latch 80 includes left and right hand plates 80 and 81 anchored to the adjacent frame segments 39 and 40 respectively. A handle 83 is pivotally mounted to plate 82, and a locking arm 83 is rotatably attached to handle 84. By rotating handle 84 upwardly, locking arm 83 is disengaged from the left hand plate 81, so that the adjacent side wall panels 4 can be easily disassembled. Rotation of handle 84 downwardly pulls locking arm 83 against left hand plate 81, such that the adjacent side wall edges are held abuttingly together. Handle 84 is rotated downwardly until it assumes an overcentered, locked position. After all three latches 24, 70 and 80 have been locked, the assembled side wall 3 is securely interconnected and attached to base 2 in a manner capable of supporting roof 5 thereon.

Figure 13:
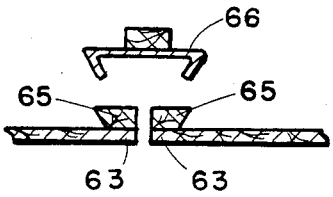
FIG. 13 is a lateral cross-sectional view of a dovetail joint for interconnecting the side edges of adjacent panels.
Figure 14:
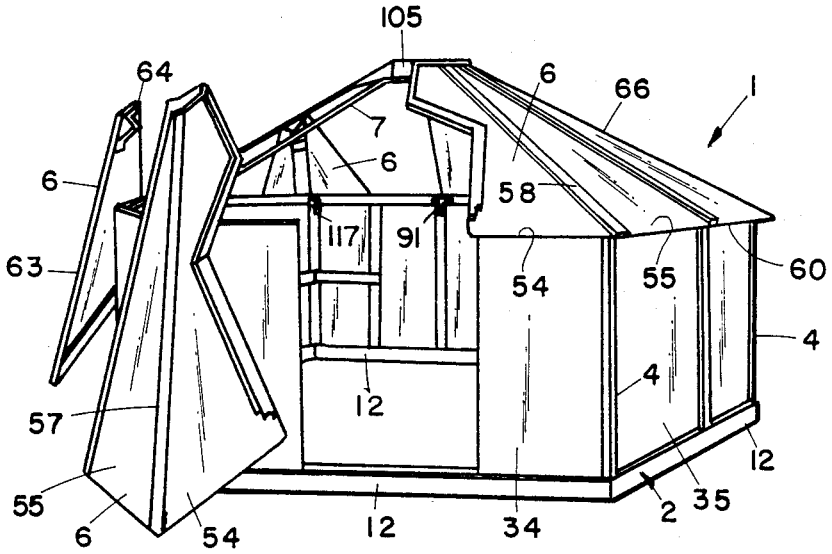
FIG. 14 is a perspective view of the portable shelter, shown in a partially assembled condition.

As best illustrated in FIGS. 7 and 8, roof panels 6 are also dihedrally shaped, and comprise a pair of flat sheets 54 and 55, which are rigidly interconnected along a common edge 56 in an angular relationship which mates with and covers the upper edges of the adjacent side wall sheets 34 and 35 of an associated side wall panel 4. In the illustrated example, roof sheets 54 and 55 have a substantially identical, generally triangular shape, are constructed of plywood, and have an included angle in the nature of 150°. Like side wall panels 4, roof panels 6 have a symmetrical configuration which permits them to be nested together for storage. Preferably, each roof panel 6 is constructed from a single, 4×8 foot sheet of plywood, which is cut diagonally between opposite corners, and the uncut longitudinal edges abuttingly interconnected to form the common edge 56. Hence, when the illustrated shelter is assembled, it has a floor width of 12 feet between the centers of opposite base legs 12, and a height in the nature of 88 inches. V-shaped reinforcing strips 57 and 58 are attached to the interior and exterior sides of sheets 54 and 55 along common edge 56 by suitable fasteners. The interior reinforcing rail 57 functions as a fixed rafter for the roof panels 5. A pair of stop rails 59 are attached to the interior side of roof sheets 54 and 55, and extend along the outer edges 60 thereof in a parallel fashion to abut with the side wall panels 4, as described in greater detail hereinafter. Handles 61 are attached to the interior reinforcing frame 57 to facilitate positioning roof panels 5. The outer roof panel edges 60 are preferably covered with a protective strip 62 to alleviate damage during transport. The interior side edges 63 preferably include beveled rails 65 (FIG. 13) along the exterior side thereof to facilitate interconnecting adjacent roof panels with a cap 66, in a fashion similar to the side edges of side wall panels 4, as previously described. A bracket 64 is mounted on the interior end of frame member 57, and is adapted to interconnect the various roof panels in a manner described below.

With reference to FIGS. 9 and 10, carrier rafters 7 comprise an elongate, substantially rigid beam 88, having an inverted L-shaped bracket 89 attached to the lower end thereof, and a cap or header bracket 90 connected with the upper end. A latch 91 is attached to the lower end of beam 88 on the interior side, and comprises an arm 92, having the upper end pivotally attached to beam 88 by a bracket 93, and the lower end pivotally attached to a latch arm 94. The upper end of latch arm 94 includes a hook shaped fitting 95 which opens generally upwardly and inwardly, and is shaped for mating reception into a pair of downwardly oriented hooks 96 mounted on interior side of side wall panel 4, adjacent each side edge 39 and 40. Latch arm 94 is attached to arm 93 through an elongate slot 96 and pin 96*a*, so as to provide substantial adjustment between the various latch members. A sliding lock 97 is attached to the lower end of latch arm 94, and as best illustrated in FIG. 5, is received behind a pair of mating lock plates 98 mounted on the side braces 39 and 40 of side wall panels 4. A set screw 98*a* retains sliding lock 97 in position on latch arm 94.

Referring again to FIG. 9, to attach the lower end of rafter 7 to the assembled side wall 3 and base 2, the lower, outwardly protruding end 99 of beam, 88 is inserted into a notch 100 located just above hook shaped brackets 96. Rafters 7 are moved radially outwardly, until the vertical face of bracket 89 is received between brackets 96, and abuts the interior surface of the side wall panel 4. The hook shaped fitting 95 on latch arm 94 is then inserted into the mating portions of brackets 96, and the lower end of latch arm 94 is rotated downwardly into a substantially vertical orientation, thereby pulling the rafter securely down against the side wall assembly. Locking plate 97 is then slid behind stationary lock plates 98, and secured in place on the handle by set screw 98*a*, thereby positively locking the rafter to the side wall assembly.

Cap brackets 90 (FIGS. 9 and 10) are attached to the upper ends of rafters 7, and include vertical and horizontal legs arranged in a perpendicular relationship. Vertical leg 101 includes a mounting plate 102 attached to the exterior surface thereof, with a key hole aperture 103 therethrough for purposed to be described below. The brackets 64 (FIG. 8) on roof panels 5 are substantially identical with rafter brackets 90.

Figure 11:
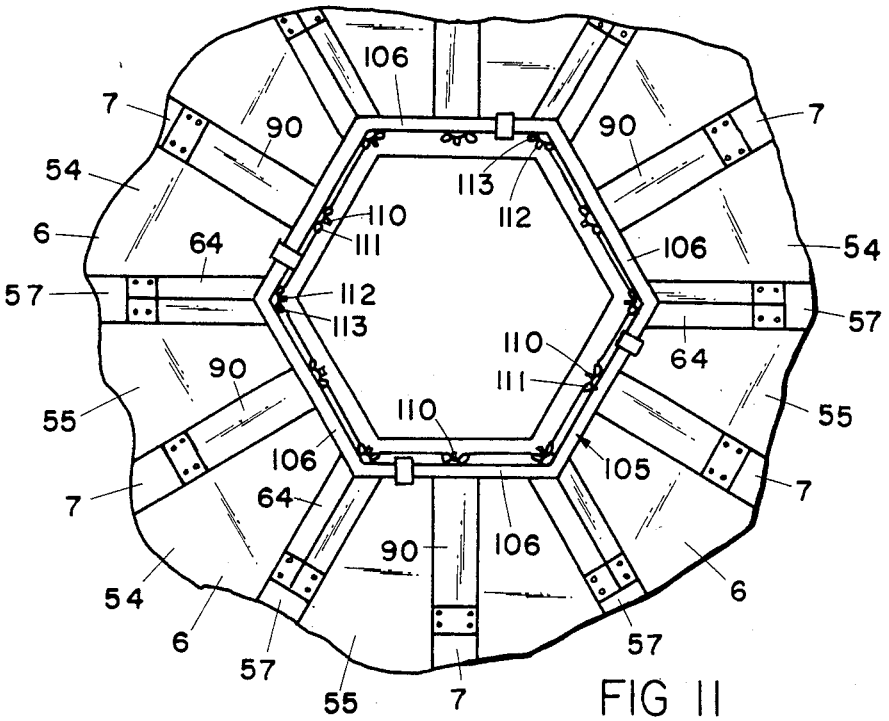
FIG. 11 is a fragmentary bottom plan view of a center portion of the shelter roof.
Figure 12:
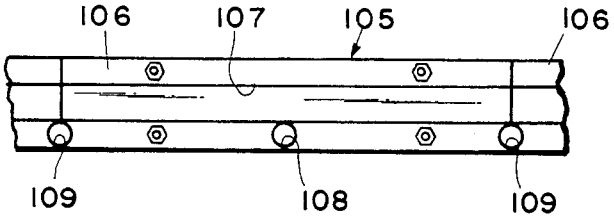
FIG. 12 is a side elevational view of a cap portion of the shelter for interconnecting the roof panel supports.

As best illustrated in FIGS. 11 and 12, the upper ends of rafters 7 are interconnected by a cap 105, having a regular, polygonal shape which is geometrically similar to the shape of base 2 and erected side wall 3. In this example, cap 105 has a hexagon shape, comprising six similarly shaped legs 106 rigidly interconnected in an end-to-end fashion. The exterior perimeter of cap 105 includes a channel 107 (FIG. 12) extending thereabout in which the protruding mounting plate 102 on rafter brackets 90 and roof panel brackets 64 are received and retained. Each leg 106 of cap 105 also includes a medial aperture 108 and a pair of corner apertures 109 through which suitable fasteners extend to positively connect the upper ends of rafters 7 and roof panels 6 with cap 105. The upper ends of rafters 7 are attached to the medial portions of cap legs 106, as each rafter is assembled onto the erected side wall 3. Fasteners 110 are received through apertures 108, and wing nuts 111 retain the upper ends of the rafters in place.

Figure 6:
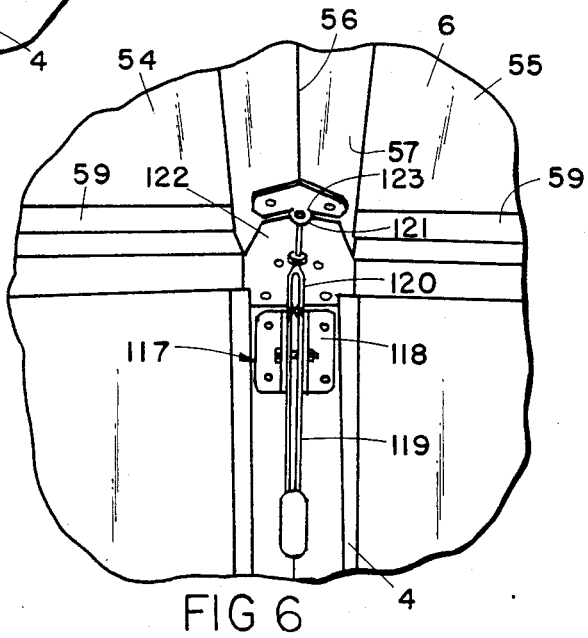
FIG. 6 is a fragmentary, perspective view of a corner latch mechanism for interconnecting the roof and side wall panels.

After all of the rafters 7 have been mounted in place, roof panels 6 are sequentially lifted onto the rafter structure, so that the free, side edges 63 of the roof panels are disposed generally over and supported by the underlying rafter 88. The stop railing 59 along the lower edge 62 of the roof panels 6 is positioned abutting the interior surface of the upper end of the erected side wall 3. Stop rails 59 are preferably positioned so that the exterior edges 60 of roof panels 6 extend over or overhand side wall 3. The upper ends of the roof panels 6 are fastened to cap 105 by positioning the protruding portion of bracket 64 in cap channel 107, attaching fasteners 112 through apertures 109, and tightening wing nuts 113. The lower ends of roof panels 6 are connected with the associated, underlying side wall panel 4 by a latch 117 (FIG. 6). Latch 117 is also an overcentered linkage mechanism, and comprises a base 118 attached to the upper end of side wall panel 4, at the corner and on the interior side thereof. A handle 119 is pivotally mounted in base 118, and carries a rotatably connected latch arm 120 with an adjustable catch 121 on the free end. A mating catch plate 122 is attached to the adjacent, corner portion of roof panel 6, and includes a socket 123 in which catch 121 is matingly received and retained. As handle 119 is rotated downwardly into a substantially vertical, locked position, latch arm 120 pulls the corner of roof panel 6 securely against the mating corner of side wall panel 4.

Roof panel clips 134 (FIG. 5) are provided at the upper side portion of each side wall panel and roof, and comprise a generally Z-shaped bracket 135 connected with the stop rails 59 with a bolt 136 projecting therefrom. Upper plate 138 of bracket 135 is shaped to engage the upper surface of stop rail 59, and the lower portion 137 of a clip 134 is attached to the upper frame segment 38 of the side wall panels, and includes a slotted, pivotally mounted plate 138, which rotates over and into engagement with bolt 136. A wing nut 139 interconnects the upper and lower portions of the clip, and retains the stop rail against the side wall panel when nut 137 is tightened. The adjacent side edges of roof panels 6 are interconnected by telescopingly inserting caps 49 over adjacent beveled blocks 48 in the exterior side of the roof. As shown in FIG. 1, a sky light 128 may be positioned over the upper end of cap 105.

With reference to FIG. 1, door 8 is preferably mounted in a dormer assembly, comprising vertical frame members 130 which support the outer end of a vaulted roof structure 131. Triangularly shaped side panels 132 fit between roof 131 and the door assembly to provide a closed construction.

The dihedrally shaped side wall panels 4 and roof panels 6 provide an extremely strong and rigid portable shelter construction, which can be easily disassembled, transported to a new location, and quickly reassembled. The various pieces of the shelter are designed to be nested together for convenient storage, and are interconnected by specially designed latches which are easy to manipulate, enable the user to assemble the shelter without tools, and remain attached to the panels, so they cannot be lost or temporarily misplaced.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A portable shelter comprising:

a collapsible base, including a plurality of legs adapted to be interconnected in a regular, polygonal configuration, and an upwardly oriented channel extending about a marginal edge of said base;

means for detachably interconnecting said base legs;

a collapsible side wall, including a plurality of dihedrally shaped panels, each comprising two sheets rigidly interconnected along a common vertical edge in an obtuse angular relationship which mates with the angle between adjacent legs of said base; each of said panels having a lower edge shaped for reception into the channel in said base, and being adapted for assembly on said base in a side-by-side relationship to form a closed perimeter;

means for releasably and detachably interconnecting said panels;

a roof enclosing a top portion of said shelter; and means for permitting ingress and egress from said shelter.

2. A portable shelter as set forth in claim 1, including:

means for positively and detachably anchoring said side wall panels on said base; and means for positively and detachably connecting said roof with said side wall.

3. A portable shelter as set forth in claim 2, wherein:

said side wall panels are free standing on said base, and support said roof on an upper edge thereof.

4. A portable shelter as set forth in claim 3, wherein:

said roof is collapsible, and comprises a plurality of panels, with means for interconnecting the same into a configuration which covers the top of said shelter.

5. A portable shelter as set forth in claim 4, wherein:

said roof panels are shaped for forming a pitched roof.

6. A portable shelter as set forth in claim 5, wherein:

said roof panels each have a dihedral shape adapted to fit over a corner portion of an associated side wall panel.

7. A portable shelter as set forth in claim 6, wherein:

said side wall panels are symmetrically shaped and adapted to be stacked together in a nested fashion for storage.

8. A portable shelter as set forth in claim 7, wherein:

said roof panels are symmetrically shaped, and adapted to be stacked together in a nested fashion for storage.

9. A portable shelter as set forth in claim 8, wherein:

said roof includes a cap having a regular, polygonal shape which is geometrically similar to the shape of said base for interconnecting the upper ends of said roof panels.

10. A portable shelter as set forth in claim 9, including:

a plurality of rafters having lower ends supported on said roof panels, and upper ends connected with said cap.

11. A portable shelter as set forth in claim 10, wherein:

said roof panels include free, side edges which extend generally radially from the center of said roof; and said rafters are positioned along each pair of adjacent roof panel side edges and abuttingly support the same thereon.

12. A portable shelter as set forth in claim 11, wherein:

said first and second named connecting means comprise latches, each having all portions thereof attached to said shelter to alleviate inadvertant loss.

13. A portable shelter as set forth in claim 12, wherein:

said shelter has a hexagonal shape.

14. A portable shelter as set forth in claim 13, wherein:

said side wall panels and said roof panels are each constructed from a conventional 4 foot by 8 foot sheet of plywood.

15. A portable shelter as set forth in claim 14, wherein:

said roof includes a dormer disposed over said ingress/egress means.

16. A portable shelter as set forth in claim 15, wherein:

said roof panels have a beveled rail extending along each side edge thereof; and including a matingly beveled cap shaped for insertion over adjacent rails to physically interconnect the associated roof panels and simultaneously form a weathertight, dovetail joint therebetween.

17. A portable shelter as set forth in claim 16, wherein:

said rails and cap are laterally tapered along their length for positively locking said roof panels together.

18. A portable shelter as set forth in claim 17, wherein:

said roof panels extend outwardly from and overhand said side wall when assembled.

19. A portable shelter as set forth in claim 18, wherein:

said base legs comprise elongate rails, whereby said shelter is without an integral floor.

20. A portable shelter as set forth in claim 19, wherein:

said side wall panels and said roof panels each include a frame about a marginal edge thereof for increasing panel rigidity.

21. A portable shelter as set forth in claim 10, wherein:

said roof panels each include a handle mounted on an interior side thereof to facilitate assembly.

22. A portable shelter as set forth in claim 21, wherein:

said side wall panel sheets are substantially flat and planar.

23. A portable shelter as set forth in claim 1, wherein:

said side wall panels are free standing on said base, and support said roof on an upper edge thereof.

24. A portable shelter as set forth in claim 1, wherein:

said roof is collapsible, and comprises a plurality of panels, with means for interconnecting the same into a configuration which covers the top of said shelter.

25. A portable shelter as set forth in claim 24, wherein:

said roof panels each have a dihedral shape adapted to fit over a corner portion of an associated side wall panel, each of said roof panels comprising two sheets rigidly interconnected along a common edge in an oblique angular relationship.

26. A portable shelter as set forth in claim 1, wherein:

said side wall panels are symmetrically shaped and adapted to be stacked together in a nested fashion for storage.

27. A portable shelter as set forth in claim 1, wherein:

said first and second named connecting means comprise latches, each having all portions thereof attached to said shelter to alleviate inadvertant loss.

28. A portable shelter as set forth in claim 1, wherein:

said shelter has a hexagonal shape.

29. A portable shelter as set forth in claim 1, wherein:

said base legs comprise elongate rails, whereby said shelter is without an integral floor.

30. A prefabricated shelter, comprising:

a base, including a plurality of legs adapted to be interconnected in a regular, polygonal configuration, and an upwardly oriented channel extending about a marginal edge of said base;

means for detachably interconnecting said base legs;

a side wall, including a plurality of panels, each comprising two sheets rigidly interconnected along a common vertical edge in an oblique angular relationship which mates with the angle between adjacent legs of said base; each of said panels having a lower edge shaped for reception into the channel in said base, and being adapted for assembly on said base in a side-by-side relationship to form a closed perimeter;

means for releasably and detachably interconnecting said panels;

a roof, comprising a plurality of dihedral roof panels shaped to be assembled in side-by-side relationship and form a substantially imperforate roof surface adapted to cover a top portion of said shelter side wall;

means for releasably and detachably interconnecting said roof panels;

means for supporting said roof panels on an upper edge of said side wall; and means for permitting ingress and egress from said shelter.

* * * * *